US011542861B2

(12) United States Patent
Gold

(10) Patent No.: US 11,542,861 B2
(45) Date of Patent: Jan. 3, 2023

(54) ENGINE FOR POWER ON DEMAND GENERATOR

(71) Applicant: VirginTricity Int'l LLC, Jackson Heights, NY (US)

(72) Inventor: Robert J Gold, Jackson Heights, NY (US)

( * ) Notice: Subject to any disclaimer, the term of this patent is extended or adjusted under 35 U.S.C. 154(b) by 0 days.

(21) Appl. No.: 17/746,912

(22) Filed: May 17, 2022

(65) Prior Publication Data

US 2022/0372910 A1 Nov. 24, 2022

Related U.S. Application Data

(60) Provisional application No. 63/189,738, filed on May 18, 2021.

(51) Int. Cl.
*F02B 63/04* (2006.01)
*F02M 21/12* (2006.01)
*F02B 45/02* (2006.01)

(52) U.S. Cl.
CPC ..... *F02B 63/048* (2013.01); *F02B 45/02* (2013.01); *F02M 21/12* (2013.01)

(58) Field of Classification Search
CPC ..... F02B 63/048; F02B 45/02; F02M 21/12; F02N 7/10; F02N 9/02; F02N 13/00; F02N 13/02
USPC ..... 123/2
See application file for complete search history.

(56) References Cited

U.S. PATENT DOCUMENTS

| | | | | |
|---|---|---|---|---|
| 3,981,277 | A | 9/1976 | Abom | |
| 4,059,077 | A | 11/1977 | Steiger | |
| 4,236,496 | A * | 12/1980 | Brownfield | F01C 11/004 123/238 |
| 4,301,774 | A | 11/1981 | Williams | |
| 4,359,970 | A | 11/1982 | Wolters | |
| 4,411,436 | A | 10/1983 | Durenec | |
| 7,009,350 | B1 | 3/2006 | Gold | |
| 7,205,732 | B1 | 4/2007 | Gold | |
| 7,784,435 | B1 | 8/2010 | Fritts | |
| 8,215,111 | B1 | 7/2012 | Richey | |
| 9,624,825 | B1 * | 4/2017 | Lockshaw | F02B 33/34 |

* cited by examiner

*Primary Examiner* — Lindsay M Low
*Assistant Examiner* — Omar Morales
(74) *Attorney, Agent, or Firm* — Chinta & Fratangelo LLP

(57) ABSTRACT

The invention provides an engine for obtaining kinetic rotational energy from the explosive decomposition of individual cartridges of an energetic material. The cartridges are individually ignited as needed, producing a bolus of hot, expanding gas, the energy of which is captured by a piston moving in a circular track. Each cartridge ignition produces a single circuit of the piston around the track. A gearing mechanism transfers the angular momentum of the piston to a flywheel. The engine may be coupled to an electrical generator to form a portable, on-demand electric generator system.

19 Claims, 13 Drawing Sheets

ENGINE FOR POWER ON DEMAND GENERATOR

RELATED APPLICATIONS

This application claims priority of U.S. provisional patent application No. 63/189,738 filed on May 18, 2021, the entire contents of which are incorporated herein by reference.

FIELD OF THE INVENTION

This invention relates generally to explosive-powered engines, and more particularly to their use in portable electric generators.

BACKGROUND

There have been attempts in the past to produce so-called "gunpowder engines", which seek to harness the energy released by ignition of gunpowder or other explosive powders, and convert it to useful mechanical motion. In one design, the so-called "Huygens' engine", a piston is driven by atmospheric pressure acting against a vacuum, the vacuum being produced by venting from a cylinder the hot gases produced by a gunpowder explosion. Other prior attempts have been based on the principle of driving a piston with the explosive force of the ignition, in direct analogy to internal combustion engines. Such devices are described, for example, in U.S. Pat. Nos. 3,981,277, 4,059,077, 4,359,970 and 7,784,435. These engines have not been successfully developed, principally due to the difficulty of metering the explosive powder into the combustion cylinder.

Civilians, businesses, first responders, militaries and governments are increasingly dependent on portable, reliable sources of electrical energy, for direct use and to recharge battery systems in portable devices. The need has been expressed in the global marketplace for man-portable emergency energy generators with the ability to supply power on demand. "Power On Demand" means that power is generated or released only as required by attached loads, so that the power reserves and fuel of the device are not wasted by operating when no load is present. Almost all current generator technologies function via continuous operation and waste fuel when there is no load to use the power generated. Thus, the fuel and the power it generates are wasted. It is a simple fact of most power generation technologies that power generated, but not used or stored, is power lost.

There are currently a number of high-capacity batteries on the market, some of which are misleadingly promoted as generators. These devices require an exterior power source to recharge their batteries. Some are designed to be recharged via attachable solar cells, but their power outputs and capabilities are limited by weather, recharge time and power flow.

A Power On Demand (POD) technology should preferably use a non-fossil fuel that by its nature is not subject to geo-political shortages, and is not dependent on a lengthy and potentially fragile supply chain. The ideal fuel will be safe to use and transport, have a shelf life measured in years or decades, and be packaged in small, rugged, modular units for easy logistics.

Another highly desirable feature of a POD generator is the ability to be used indoors with little or no ventilation. This, with the exception of batteries deceptively marketed as generators, has never been accomplished. All combustion-based generators produce highly toxic carbon monoxide (CO) as a byproduct of their burning of gas or diesel fuels, and many people are killed each year due to the use of fossil-fueled generators indoors.

The uses for POD generator technology as described above include residential and business power back-up during brown-outs and black-outs, on-the-go or in-the-field power for consumers and industry, natural disaster responses, lack of reliable power in undeveloped countries, military combat zones, and in general any situation involving a short- or long-term power outage. Buyers, accordingly, may be individual home and business owners, corporations that conduct field operations, and government agencies and militaries.

Numerous patents address portable power generation and electrical power storage systems. U.S. Pat. Nos. 7,009,350 and 7,205,732 (issued to the present inventor) mention the possible use of explosive energy to energize springs that serve as an energy storage system.

A POD generator requires a portable, storable source of energy, which can be drawn upon when the generator's output is needed. Gasoline and diesel fuels are the most common sources for portable generators, but liquid hydrocarbon fuels are subject to degradation over time by autoxidation processes, and generally should not be stored for more than 12 months. Solid energetic materials, on the other hand, are far more stable; indeed black powder dating from the American Civil War has been shown to be effective after more than a century of storage. Energetic materials are a class of material with high amount of stored chemical energy that can be rapidly released on demand, including but not limited to black powder, smokeless powder, nitrocellulose, nitroguanidine, and the like. It would be desirable to harness a solid, storage-stable energetic material for POD generation in emergencies, and the present invention is intended to provide an effective mechanism for doing so.

SUMMARY OF THE INVENTION

The primary energy supply for the invention is the rapid decomposition of an energetic material to create a hot, high-pressure gas. The explosive force thus produced is captured by a piston running in a circular track, which is coupled to a flywheel which stores the generated kinetic energy. The kinetic energy of the flywheel is drawn off as needed to power a generator, and replenished as needed by the ignition of additional charges. In preferred embodiments, a battery stores any generated electrical energy that is in excess of the immediate demand, and power can be drawn from the battery and/or the generator as directed by a computerized power management system.

Energetic materials capable of rapid, explosive decomposition, rather than detonation, are preferred; in general the propellants known to be useful in weaponry and powder-activated tools are suitable for use in the invention. The energetic material may be stored and used in the form of individually addressable energetic cartridges. For convenience and clarity, the terms "energetic material" and "energetic cartridge" will be used herein to refer to any and all explosive powders and propellants, including but not limited to gunpowder, black powder, smokeless powder, and other equivalent materials.

BRIEF DESCRIPTION OF THE FIGURES

The drawings are representative examples of various embodiments of the invention, which is not limited to the illustrated examples.

DETAILED DESCRIPTION OF THE INVENTION

Figure 1:
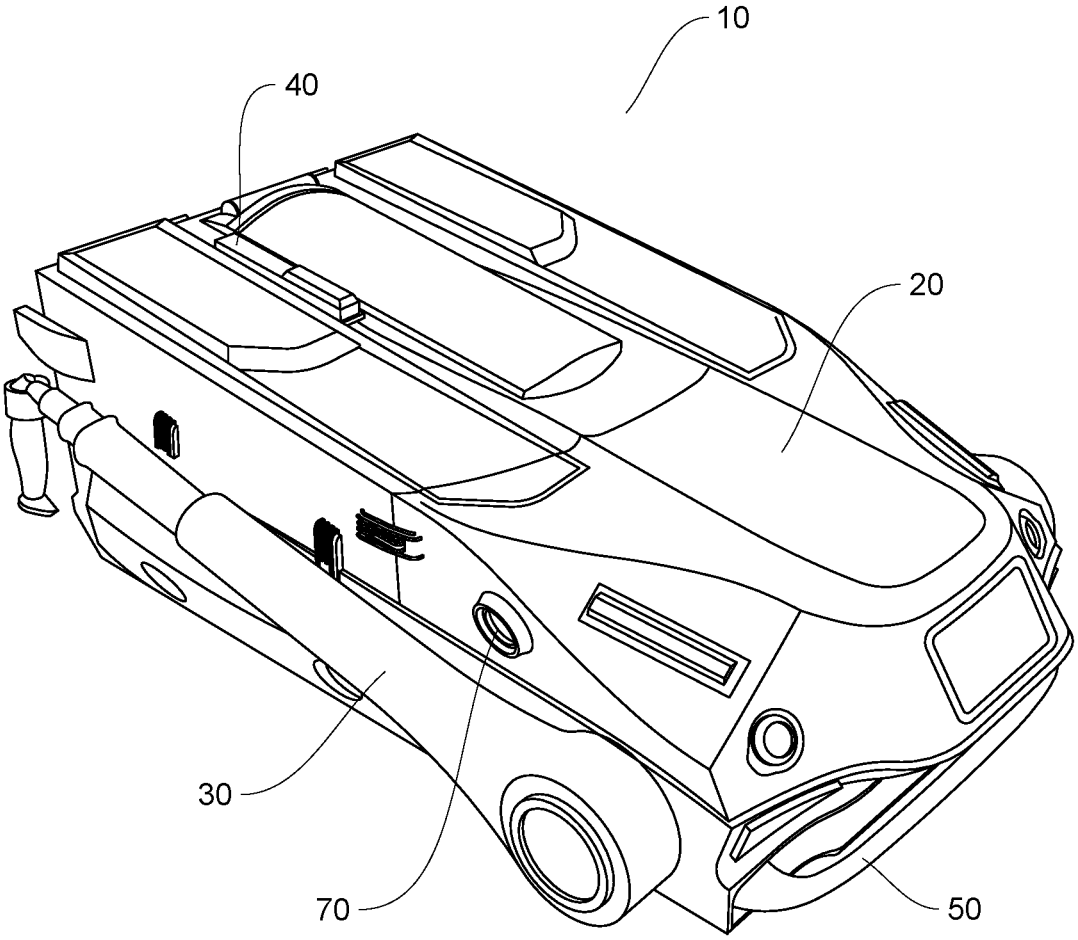
FIG. 1 is an exterior view of a POD generator of the invention.

Broadly, the invention provides an engine for obtaining kinetic rotational energy from the explosive decomposition of an energetic material. The engine features an annular piston track comprising a stationary wall section and a rotating wall section, the rotating wall section facing the axis of the annulus and being free to rotate around the axis of the annulus.

Securely fixed to the rotating wall section is a piston, which fits closely within the annular piston track and which travels around within the annular piston track as the rotating wall section rotates. Disposed on the side of the rotating wall section exterior to the annular piston track and facing the axis of the annulus are evenly-spaced gear teeth, arranged so that the rotating wall section is capable of serving as (i.e. has the function of) an annular gear. A gear train, comprising a pinion gear operatively engaged with the annular gear, is activated by rotation of the annular gear. The gear train transfers rotational motion to a central output shaft, which is preferably located on the axis of the annular gear. A one-way clutch is operatively engaged with the gear train, via the output shaft, and with a flywheel, the one-way clutch being oriented to transmit torque from the output shaft to the flywheel.

The engine of the invention further comprises a power flow entry tube, adapted at its near end to receive expanding gases produced by the explosive decomposition of an energetic material, and terminating at its distal end in an attached partition, the partition having a port that passes through the partition. The port delivers the expanding gases into the annular piston track behind the piston, so as to propel the piston forward and around the annular piston track.

A pivot is integrated into the power flow entry tube, which enables the distal end of the power flow entry tube and its attached partition to rotate between a first state in which the partition seals the annular piston track, and a second state in which the partition is entirely clear of the annular piston track. A movable stop pawl, operatively linked to the partition, is movable into and out of the annular piston track, its position depending upon the state of the flow entry tube and its attached partition. Specifically, the rotation of the partition into the second state causes the stop pawl to move into the annular piston track and halt the movement of the piston. The distal end of the power flow entry tube and the attached partition are configured to rotate from the first state to the second state when displaced by the piston, so as to permit passage of the piston, and are configured to rotate back into the first state after passage of the piston. After passage of the piston, the stop pawl is configured to move out of the annular piston track, when the flow entry tube and the partition rotate back into the first state.

The engine of the invention may further comprise (a) a user-operated mechanism operatively linked to a magazine holder, for drawing an individual charge of the energetic material from a magazine and transferring the charge into the near end of the power flow entry tube; and (b) a user-operated mechanism for igniting the individual charge within the power flow entry tube.

The magazine holder is preferably configured to hold a magazine of individual charges of the energetic material. The individual charges of the energetic material within the magazine are preferably uniformly spaced along a flexible belt.

The invention also provides a portable on-demand (POD) electrical generation system, comprising the engine described above, operatively linked via a second one-way clutch to a generator, the second one-way clutch being oriented to transmit torque from the flywheel to the generator. In this POD electrical generation system, the engine of the invention may further comprise (a) a computer-operated mechanism, operatively linked to a magazine holder, for drawing an individual charge of the energetic material from a magazine and transferring the charge into the near end of the power flow entry tube; and (b) a computer-operated mechanism for igniting the individual charge within the power flow entry tube. The POD electrical generation system preferably further comprises a battery for storing electrical energy.

In preferred embodiments, the POD electrical generation system further comprises a computer configured to monitor (a) the charge state of the battery, (b) an electrical load placed on the generation system, and (c) the rotation speeds of the flywheel and generator. The computer is preferably further configured to operate the mechanism for transferring an individual charge of the energetic material into the near end of the power flow entry tube, and the mechanism for igniting the individual charge within the power flow entry tube. The computer preferably operates these mechanisms in response to the need for electrical power presented by the load.

The invention employs a magazine-fed modular energetic chemical cartridge or "blank" charge, which when ignited produces an explosive deflagration within a containment chamber that is used as an on-demand energy source. The cartridges are mounted in a rack or magazine, or on a flexible belt. Any of the cartridge handling mechanisms known for use in automatic or semi-automatic weapons or powder-activated tools may be employed in the present invention; one particular embodiment has been selected for illustration in the drawings, and is described in detail below. The use of magazine-fed pre-formed cartridges avoids the disadvantages of prior art devices, which invariably have problems delivering a steady flow of consistently-metered powder charges.

The explosive energy released by the ignition of a blank produces a bolus of hot, high-pressure expanding gases that is captured to drive a single rotation of a rotating energy capture system. The rotating energy capture system uses a piston in a circular track to convert the energy of the high-pressure gas into rotational motion, avoiding the disadvantages of prior art reciprocating piston-and-cylinder mechanisms.

The blanks preferably utilize a specifically-formulated energetic material, which may take the form of a powder or an amorphous solid, putty or gel. The construction of the blanks may be in a format similar to the standard explosive cartridges that are used in ceremonial or stunt weapons, nail guns, or marine line-throwing guns. Such cartridge-based units may have, e.g., brass, plastic, or cardboard casings, and most often contain a powder propellant. Preferably the blanks leave little or no residual material behind, other than the spent cartridge casings.

The ignition of the blanks can be initiated by a physical impact on an explosive primer, such as lead styphnate or mercury fulminate, as used in ordinary ammunition or nail gun blanks. The primer is preferably embedded as an integral part of the cartridge body.

Alternatively, cartridgeless blanks may be formed from a molded explosive composition comprising a propellant and one or more optional binders, without an enclosing casing, although they may have a protective paper, wax, or polymer covering. Cartridgeless blanks can be activated via the impact of a firing pin on an impact-sensitive primer molded into the blank, by electrical ignition of an electrically-ignitable primer, or by an electrical discharge between electrode needles that are inserted into the blank propellant itself at the time of firing. Electrical ignition of ammunition is described in U.S. Pat. Nos. 5,646,367, 6,131,515 and 7,574,960, each of which is incorporated herein by reference. The terms "cartridge", "blank", "charge" and "explosive charge" will be used interchangeably herein to refer to both cartridge-based and cartridgeless blanks, unless the context clearly requires that physical cartridges are being referred to.

The individual blanks may be contained within any of the several types of magazine that are known in the firearms art. The magazines are reliable, safely storable, reusable and reloadable into the engine of the invention. Each magazine can be built to hold a large number of the blanks in a format that delivers the blanks for use as needed. Multiple blanks can be attached to belts or strips, as are commonly used in nail guns and other powder-actuated tools, which can be mounted in a magazine that delivers the blanks in serial fashion.

The magazines or strips of blanks can be stored before use within sealed bags, of a metalized film or other air-tight material, optionally having a dry and/or inert gas environment surrounding the blanks. Blanks stored in this manner can be expected to retain their full energetic potential for a decade or more. In preferred embodiments, the magazines are designed to be reloaded with new blanks and reused in the invention.

The engine of the invention employs a piston, running in a circular track, to convert the energy released by ignition of an explosive charge into kinetic energy. Integral gearing within an unpressurized center section of the rotational energy capture system transfers the angular momentum of the piston, via a one-way clutch, to a connected flywheel, with a considerable increase in rpm (30-fold or more).

The flywheel can be connected via a second one-way clutch to a generator and battery system, providing a portable POD generator for the generation, storage, management and release of electric power. The POD generator creates a desired level of electrical power for a period of time, in the process gradually depleting the rotational speed and kinetic energy of the flywheel. Explosive releases from the ignition of successive cartridges can be timed to maintain the kinetic energy of the flywheel. The timing can be provided by a computer running an algorithm that manages the energy output of the system so as to meet the demands of the battery and the loads placed upon the POD generator. The ignition of charges may be halted when the load is light or non-existent, or they may be continued so as to add energy to the battery against anticipated future loads. Preferably, the user is provided with means for manually introducing and igniting cartridges as well. In alternative embodiments, the algorithms can be run on the processor of a smart phone, which can communicate wirelessly and securely with a receiver integrated into the POD generator.

In the embodiment illustrated herein, the POD generator is also adapted to accept the energy input of human body kinetics (HBK), i.e. the muscular effort of the user, as a low-power generation option. Extendable levers that can be manipulated by a user's arms are linked to the flywheel, enabling the user to gradually load kinetic energy into the flywheel and, through the generator, load electrical energy into the battery. A typical healthy adult human can maintain a mechanical power output of about 100 watts for about an hour. Because the energy input by HBK will accumulate in the battery system, HBK could generate a substantial amount of stored energy over time, especially if multiple users, working in shifts, input their personal physical energy.

Both sources of energy (manual HBK and explosive energy release) create angular momentum, which is transferred to a flywheel via one-way clutch mechanisms. In the POD generator, the flywheel is operatively linked, also via a one-way clutch, to an electric generator. The one-way clutches may be mechanical devices, for example friction, centrifugal, or roller clutches, or they may be electromagnetic clutches, which can be engaged and disengaged by the computer control system. An electromagnetic clutch may be inherently one-way due to its structure, or it can be operated in a one-way manner by computer control in response to the output of speed sensors that monitor the rotation rates of the connected components.

The flywheel enables the generator to operate continuously even when the energy input is sporadic, and the one-way clutch enables the flywheel to spin freely, retaining its kinetic energy, when there is no electrical load on the generator. The overall system is designed to optimize the production of electrical energy, and store the energy in an integral electrical power storage system, which is managed and optimized by the control algorithms. The control algorithms can activate, on demand, the magazine-fed modular explosive kinetic energy release to maintain power generation as needed, via the activation of the rotational energy capture system, flywheel and generator, all of which have rotational speed sensors that inform the invention's computer control system.

The POD generator is structured so that electrical energy can be generated and stored automatically, at the same time that stored electrical energy is being distributed on demand to multiple loads managed by the computer-controlled power storage system. If required, the generator and the electrical power storage system can output power simultaneously to one or more exterior loads placed on the system.

The POD generator utilizes a modular, rechargeable multi-battery system or "battery stack", which contains, in addition to batteries, one or more electrical systems that are configured to create a transistor-controlled power distribution matrix enabling the system to route power through multiple power transfer nodes out of the battery system to one or more output ports (including but not limited to wire wrap posts, USB ports, standard domestic electrical outlets, car lighter plugs and other specialized outputs) at voltages and power levels needed to properly supply the loads placed on the POD generator. The electronics are preferably adapted to permit multiple units of the POD generator to be daisy-chained together to produce a higher and/or more durable total energy output. A suitable multi-battery power management and power distribution system has been described in U.S. Pat. No. 7,205,732, the entire contents of which are incorporated herein by reference.

The sound and particulates produced by the exhaust of the explosive kinetic energy releases are mitigated via sound damping and particle capture systems. The exhaust system is modular, with removeable, cleanable and replaceable filter elements that maintain sound and particulates at levels compatible with use indoors, minimizing the amount of ventilation required.

The casing of the POD generator is water-resistant and ruggedized, so it can be used as a portable device in extreme conditions. The casing material may be conductive, or alternatively the interior of the casing may be lined with a metal grid, providing a Faraday cage that protects the interior electronics and power generation components from electromagnetic pulses (EMP). The casing may have integral wheels and/or skids, and an extendable handle, so that it is capable of easily being maneuvered on different terrains. The casing is preferably provided with integral attachment hard points, where various transport accommodations such as air transport hold-downs, parachute cords, flotation collars, and backpack straps can be attached. The mass and volume of the POD generator as a whole are preferably scaled so that a single individual can carry or tow the device.

The explosive engine and POD generator will now be described with reference to the attached drawings. It should be understood that the drawings, and the descriptions below, are intended to illustrate representative embodiments of the invention, and that obvious alternatives, substitutions, and equivalents to the elements shown and described are not excluded or disclaimed on account of their omission from the present disclosure.

FIG. 1 is an isometric view of a POD Generator 10 of the invention, shown in its stowed configuration. The system shown is encapsulated within a rugged, waterproof main casing 20. The main exterior sub-systems illustrated include the main casing 20; the left armbar 30 (shown in its stowed position); and magazine holder 40 of the cartridge activation system. A retractable handle 50 provides for convenient moving of the device. Hot air from an internal cooling system is vented through exhaust port 70. Not shown are hardpoints suitable for the attachment of backpack or tie-down straps, a parachute, or a flotation collar, or the retractable wheels at the rear. The general shape of the unit is preferably rectangular, which allows it to be boxed for efficient mass storage. In some embodiments the case may be shaped to enable stable stacking of the unboxed devices.

Figure 2:
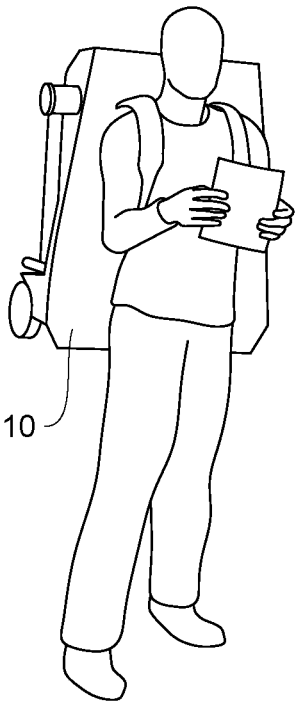
FIG. 2 shows the POD generator being backpacked.
Figure 3:
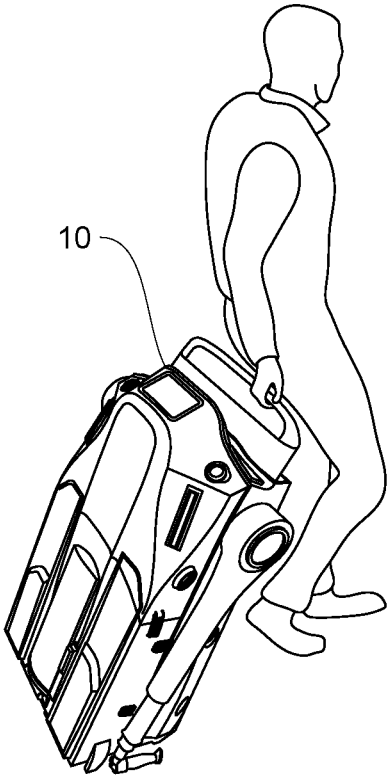
FIG. 3 shows the POD generator being towed.

FIG. 2 illustrates a POD generator 10 of the invention being backpacked by a user via the use of shoulder straps connected to integral case hard points, and FIG. 3 illustrates a POD generator of the invention being rolled on retractable wheels (not shown), using the pull-out handle 50 to tow the device like a piece of luggage.

Figure 4:
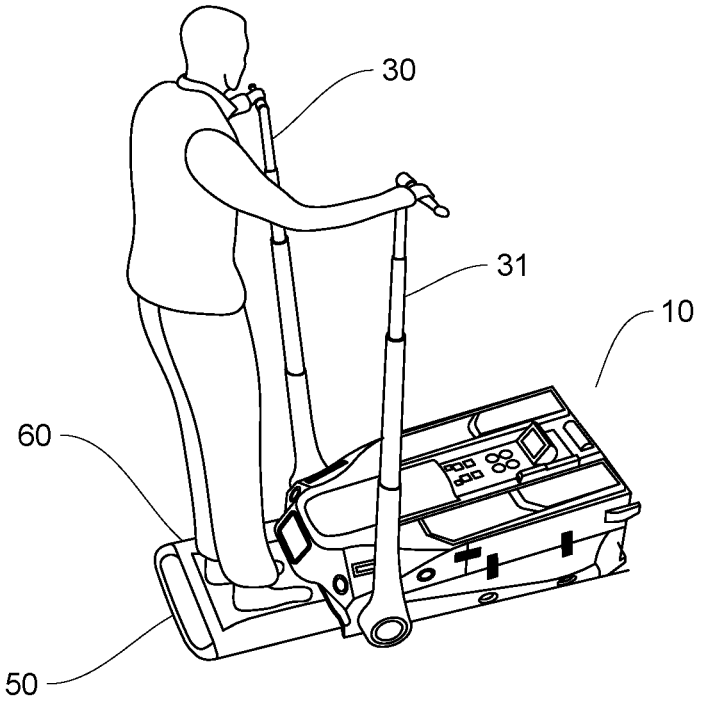
FIG. 4 shows the POD generator being energized by human muscular effort.

FIG. 4 illustrates a user standing on extended stability pad 60, which serves to anchor the POD generator while the user inputs energy via the armbars 30 and 31. The extended length of the armbars provides sufficient leverage to enable a moderate force on the armbars to apply sufficient torque to the flywheel to produce a sustainable low-level output of electrical energy from the generator, sufficient for low current loads and/or for adding stored power to the battery system.

Figure 5:
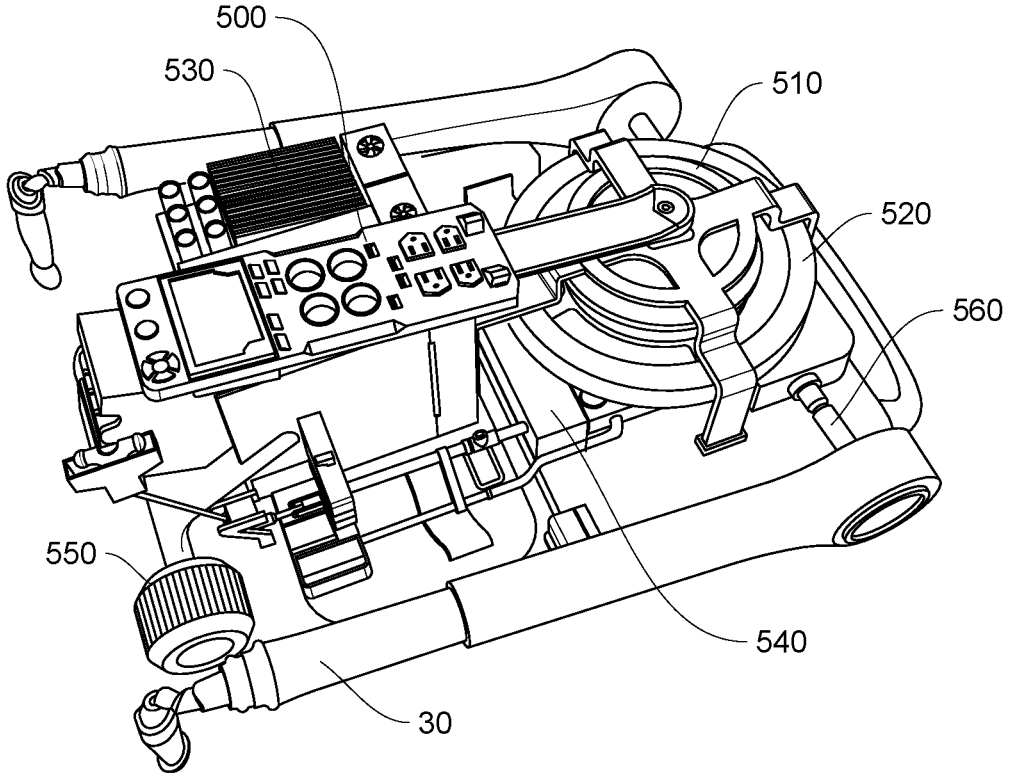
FIG. 5 is a perspective view of the interior of a POD generator of the invention.

FIG. 5 is a perspective view of the interior of a POD generator of the invention, with the casing removed. Control panel 500 is seen on the upper surface. Generator 510 sits above the flywheel housing 520 and explosive engine 540. Retractable wheels 550 are visible in this view, as is the HBK drive axle 560. The fins 530 of the heat sink, which serve to cool the batteries, are adjacent to the control panel.

Figure 6:
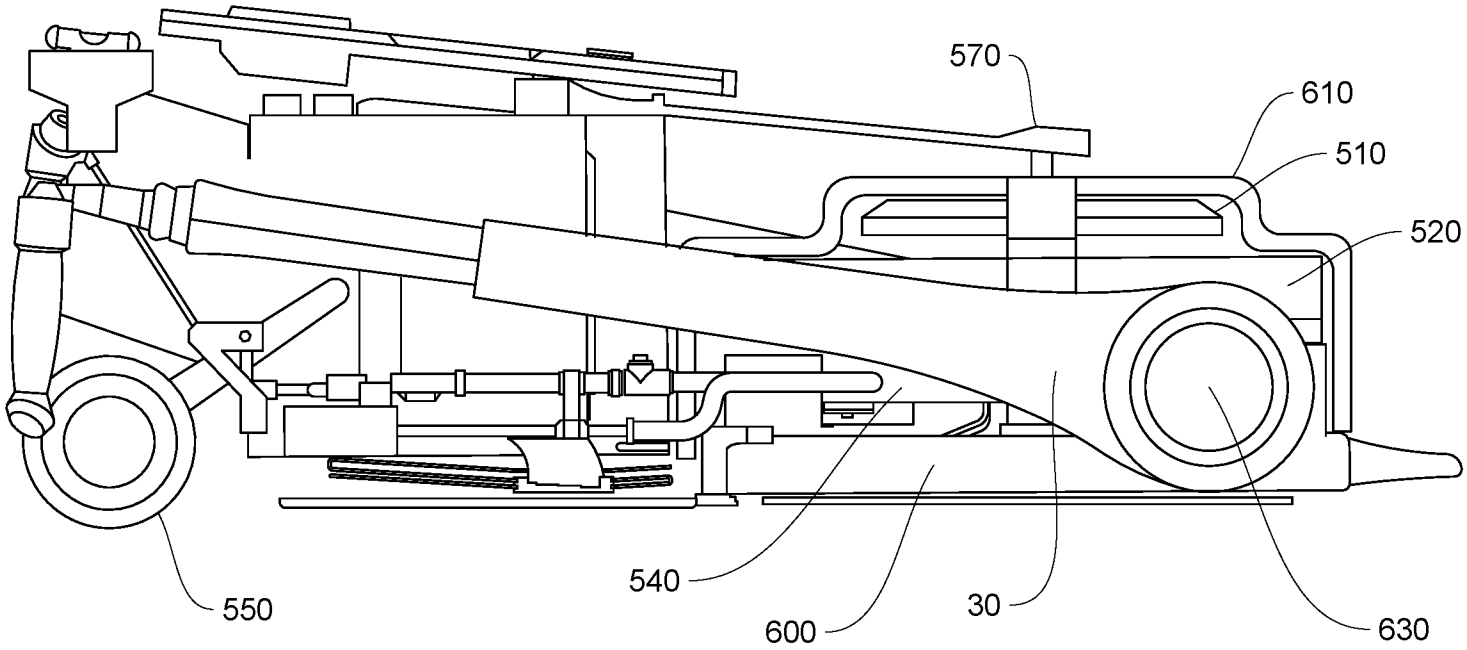
FIG. 6 is a side view of the interior of a POD generator of the invention.

FIG. 6 shows a side view of the same interior. The bottom panel 600 is a flat chassis on which all components are mounted and supported. The bottom panel 600 has a hollow interior in which the retracted stability pad 60 is stowed. The arm bar 30 is shown in its stowed (telescoped) and locked state. The arm bar is connected to an arm bar hub 630, which is operatively linked to HBK drive axle 560 via an internal ratchet mechanism (not shown). Visible behind the arm bar 30 is the X-frame 610, which provides a rigid structure for the secure mounting and co-axial alignment of the rotating elements of the explosive engine 540, flywheel (within housing 520), and generator 510. A power transfer interface 570 connects the generator 510 to the control panel 500.

Figure 7:
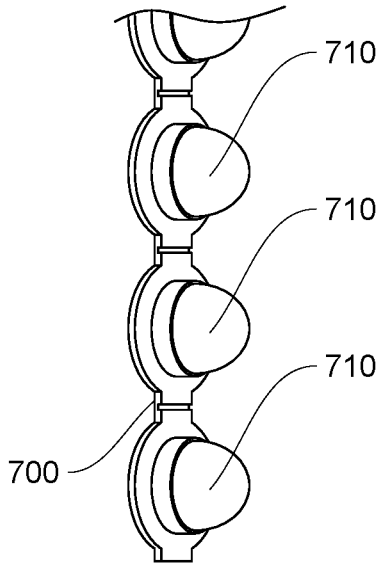
FIG. 7 is a section of a belt carrying cartridgeless explosive charges.

FIG. 7 shows the terminal portion of a belt 700 carrying a series of explosive charges 710. The charges in this illustration are of the cartridgeless design, i.e. they consist almost entirely of a solid, molded energetic material, along with any binders and coatings that might be required for mechanical and chemical stability.

Figure 8:
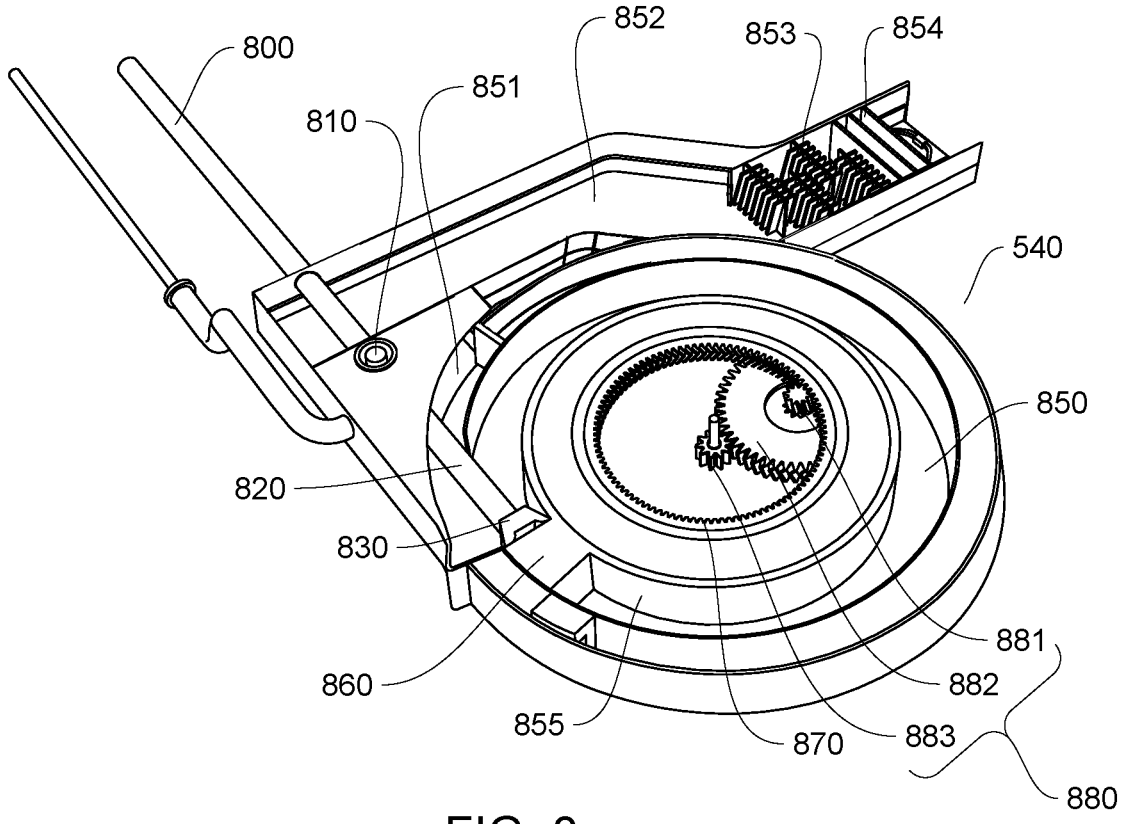
FIG. 8 is a cutaway view of an explosive engine of the invention, in ready-to-fire configuration.
Figure 9:
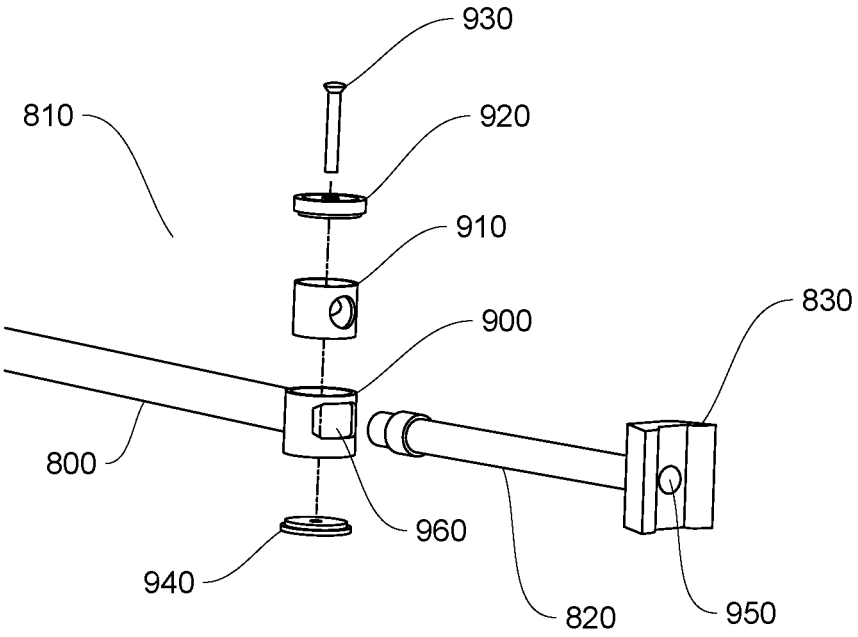
FIG. 9 shows the components of a pivoting power flow entry tube.

FIG. 8 is a top cutaway view of the components of the explosive engine 540 in a ready-to-fire state. Expanding gases from the firing of an energetic cartridge will be generated within power flow entry tube 800, pass through the power flow tube pivot 810 and into the straight tube section 820, which terminates at the partition 830. (The elements of the tube pivot 810 are shown in FIG. 9.) A release port in the partition 830 allows the expanding gases to flow into the power piston track 850, directly behind the power piston 860. The expanding gases propel the power piston 860 around the interior of the power piston track 850. The circular motion of the piston is accompanied by the rotation of the attached gear ring 870, and through the operation of the gear train 880, this is converted to rotation of the output shaft 890.

Initially, upon the entry of the expanding gas, the power piston 860 is in close proximity to the one-way release port 950 in partition 830, as shown in FIG. 8. The power piston 860 fits closely within the piston track 850, forming a sliding seal with the upper, lower, and outer walls of the track, but is permanently attached to (or is integral with) the inner wall 855 of the piston track. The inner wall 855 of the track is movable with respect to the rest of the track, because it is also the outer surface of the annular gear 870, which rotates as the piston travels around the track. The rotation of the annular gear 870 causes rotation of the primary pinion gear 881, which is fixed to step-up gear 882. Rotation of the step-up gear rotates hub gear 883 which is fixed to output shaft 890. Output shaft 890 is connected to the flywheel clutch (not shown.) The gearing converts the average rotation of the annular gear 870 (roughly, on average, 120 rpm) into lower-torque but higher-speed rotation of the output shaft 890. Preferably, the gearing is such that the output shaft is driven at a 30:1 to 50:1 ratio relative to the rotation rate of the annular gear.

The gases in the track 850 ahead of the moving power piston 860 (principally exhaust gases from the previous stroke of the engine) are forced out through internal exhaust exit 851 and into exhaust chamber 852. Exhaust chamber 852 directs exhaust gases through a series of noise-reducing baffles 853 and particulate filters 854 before exiting. The operation is similar to that of a conventional piston in a cylinder, but with the cylinder being wrapped around on itself to form a torus, so that the cylinder returns to its starting point. With this structure, every stroke of the piston is simultaneously a power stroke and an exhaust stroke.

FIG. 9 shows the components of the of the tube pivot 810. Power flow entry tube 800 terminates in, and discharges into, the pivot housing 900. Pivot core 910 fits within and rotates within the housing 900, and is held in place between lower cap 940 and upper cap 920, secured by the bolt 930. Straight tube section 820 threads into the core 910 through the window 960 in pivot housing 900. The window 960 is wide enough to permit tube section 820 to swing through an arc as the core 910 rotates within housing 900. The bore of straight tube section 820 opens into a release port 950 in the partition 830.

Figure 10:
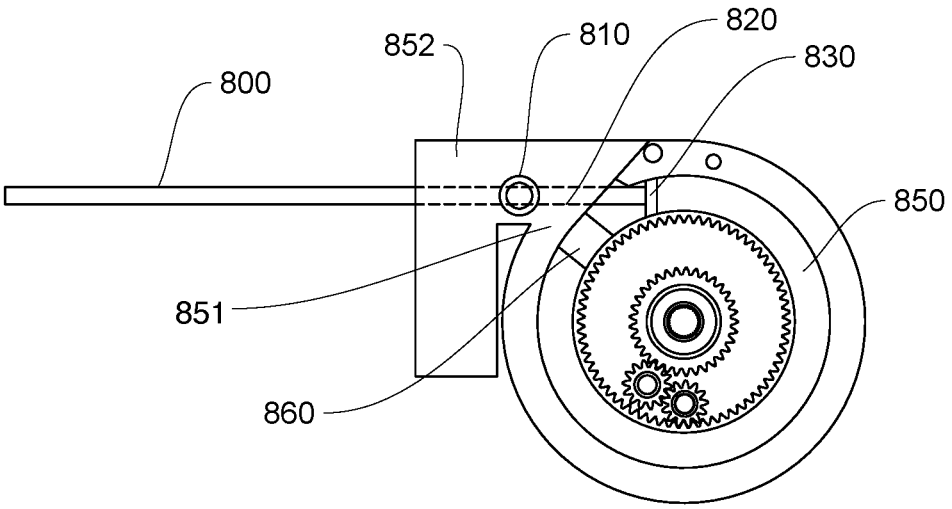
FIG. 10 is a schematic of the explosive engine, showing the piston approaching the end of a power cycle.

FIG. 10 schematically illustrates the explosive engine at one point in its operation, a fraction of a second after ignition of an explosive charge. The power piston 860 has completed about 90% of a rotation, and has just contacted the straight tube section 820, initiating rotation of the straight tube section about the power flow tube pivot 810. Piston 860 has also just cleared the edge of exhaust exit opening 820, and the expanding gases driving the piston 860 are beginning to vent into exhaust chamber 852. The venting of the gases removes the propulsive force behind piston 860, in preparation for stopping the piston and preparing the system for the next ignition of an energetic cartridge. The gear train in FIG. 10 represents an alternative to that shown in FIG. 8.

FIGS. 11-15 show in detail the motion of several components as the power piston 860 completes its cycle and re-sets itself for the next firing of an energetic cartridge. These drawings are intended only to schematically convey the operative interactions and relative motions of the illustrated components, and are not intended to accurately represent the shapes, sizes or structures of the components.

Figure 11:
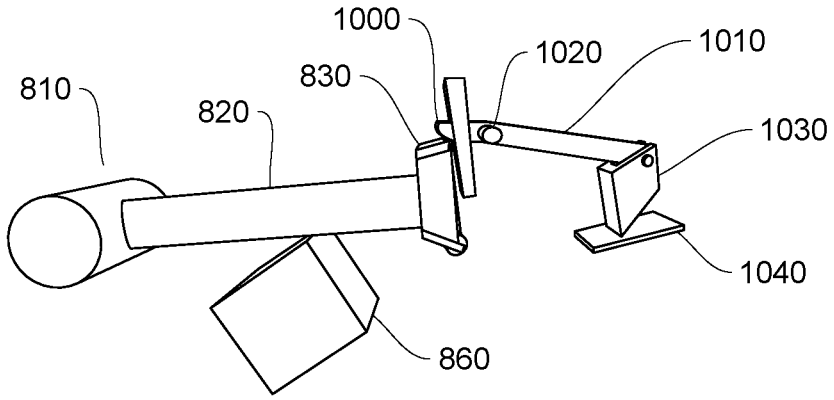
FIGS. 11-15 are schematic illustrations of the displacement and re-setting of the power flow entry tube and stop pawl at the end of a power cycle.

FIG. 11 shows the straight tube section 820 of the power flow entry tube beginning to rotate around the power flow tube pivot 810 due its displacement by the advancing piston 860. As a result of this displacement, the attached partition 830 rises to contact the stop pawl rotation nub 1000 protruding through the access slot 1010. Straight tube section 820 is spring-loaded, with a tube biasing spring (not shown) biasing the straight tube section against displacement by the piston, i.e., toward the straight tube's resting position within the piston track. The tube biasing spring absorbs and momentarily stores some of the kinetic energy of the piston as it displaces tube section 820. Displacement of stop pawl rotation nub 1000 puts stop pawl rotation lever 1010 into motion around pivot 1020, causing stop pawl 1030 to push against, and open, stop pawl hatch 1040. Stop pawl hatch 1040 is spring-loaded, with a spring (not shown) biasing the hatch toward the closed configuration, in which the hatch is flush with the interior surface of the piston track 850.

Figure 12:
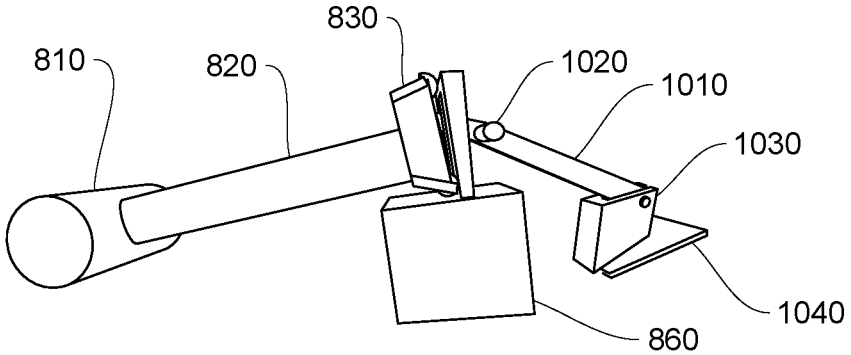

FIG. 12 shows the rotational power piston 860 having completed about 99% of a rotation, at which point the straight tube section 820 and partition 830 are fully displaced, allowing piston 860 to move past the partition. The stop pawl rotation nub 181*h* is now fully displaced, resulting in further rotation of stop pawl rotation lever 181*r* and the full extension of stop pawl 181*c* through open stop pawl hatch 181*s* and into the path of the moving piston 860.

Figure 13:
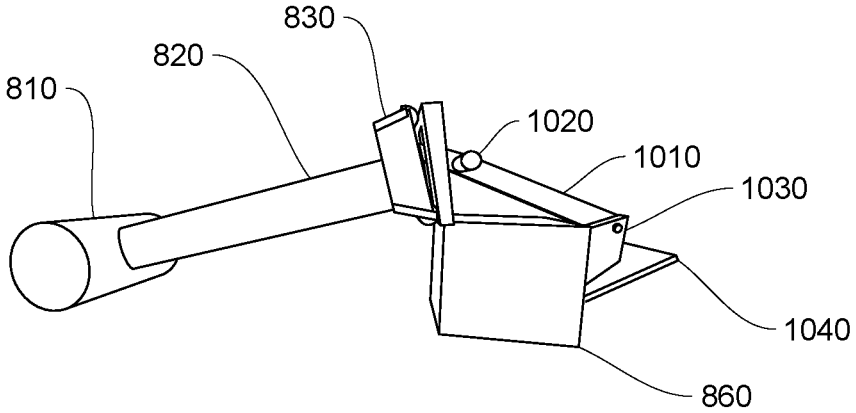

FIG. 13 shows rotational power piston 860 at its 100% rotation position, where it has contacted fully-extended stop pawl 1030. Contact with the stop pawl halts the motion of the piston at a point where it is clear of partition 830. A partition sensor (not shown) relays a signal to the computer control system indicating the position of the partition. This ensures that ignition of an energetic cartridge does not take place unless the tube and partition are in their starting configurations, positioned to deliver the expanding gases behind the piston. Contact of the piston 860 with the stop pawl necessarily halts the rotation of the annular gear 870 and the speed amplification gear system 880. The flywheel, however, continues to spin, through the operation of the flywheel clutch which releases the flywheel from the now-decelerating engine.

Figure 14:
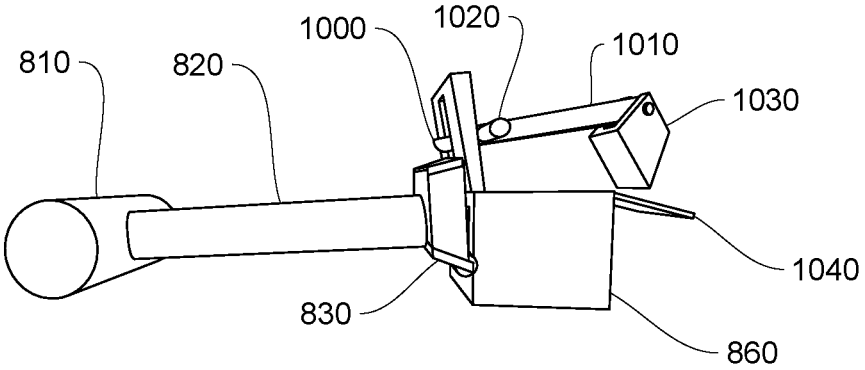

FIG. 14 shows the straight tube section 820 and partition 830 dropping back to their starting positions behind piston 860, propelled by the tube biasing spring. This releases the top pawl rotation nub 1000 so that stop pawl rotation lever 1010 can rotate back to its starting position, retracting stop pawl 1030 and permitting stop pawl hatch 1040 to close, sealing the piston track 850 and clearing it for the next rotation of the piston 860. Retraction of the stop pawl 1030 may also be driven by the tube biasing spring.

Figure 15:
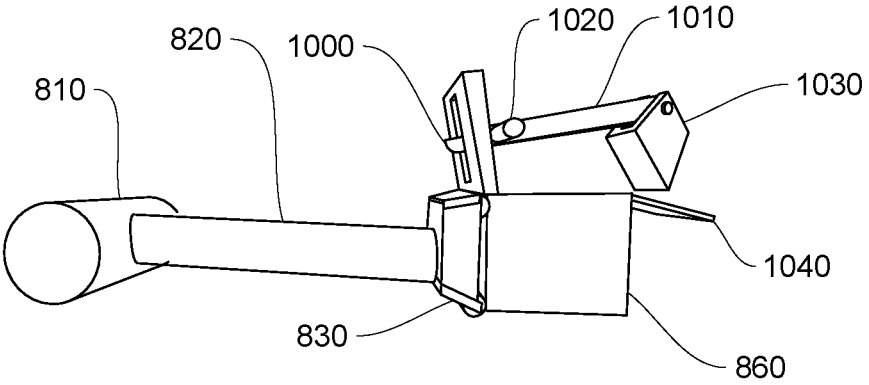

FIG. 15 shows power piston 860 in its starting position in the power piston track 850, with straight tube section 820 and partition 830 fully returned to their starting positions behind it. The expanding gases in the piston track 850 have been fully vented, and the track ahead of the piston 860 is at atmospheric pressure. The system is now in its starting configuration and ready to capture another explosive charge. The partition sensor will indicate to the computer control system that the device is ready for the next firing of an energetic cartridge, if needed to maintain the rotation of the flywheel and the generation of sufficient electricity to meet the current load.

Figure 16:
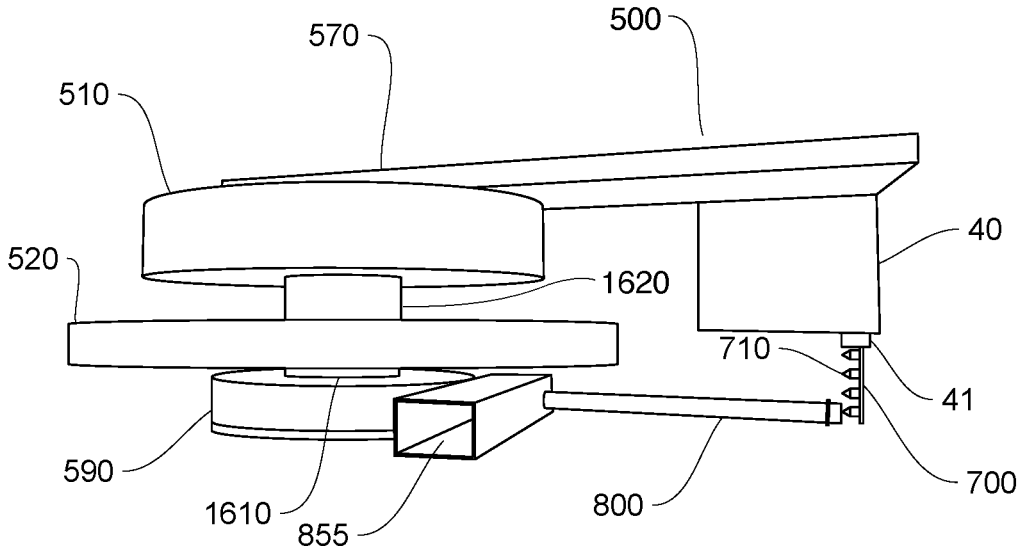
FIG. 16 is a side view of the assembled active components of the generator system.

FIG. 16 is a schematic overview of the explosive engine and main electrical power generation system components. The components include magazine holder 40, containing a loaded magazine (not shown) with its exit port 41 protruding from the bottom of the magazine holder. A strip 700 of explosive charges 710 is shown, being sequentially fed into the flow entry tube 800. Entry tube 800 leads into the explosive engine 590 (detailed above), showing exhaust port 855. Flywheel housing 520 is shown directly above the explosive engine 590. The flywheel clutch assembly 1610 protrudes from the center of the flywheel housing and connects drive shaft 890 to the flywheel. The generator clutch assembly 1620 likewise connects the flywheel to the shaft of the generator 510. The control panel assembly 500 sits above the generator system 510, to which it is connected via power transfer interface 570 (not visible).

Figure 17:
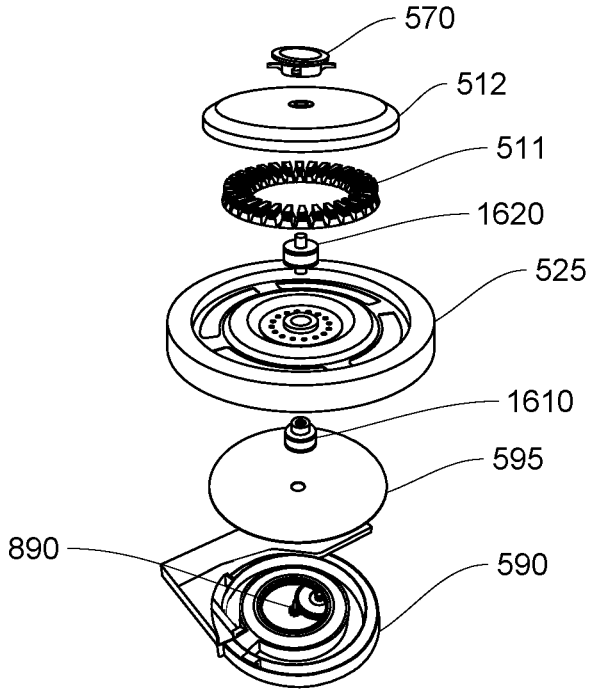
FIG. 17 is an exploded view of the engine, flywheel, and generator assembly.

FIG. 17 is an exploded view, showing the rotating components in greater detail. The explosive engine 590 is shown at the bottom of the exploded stack of components. The output shaft 890 of the explosive engine transfers motion from the gear train of the engine through engine cover 595 to the flywheel clutch 1610. The flywheel clutch is a one-way clutch, which mechanically couples the output shaft 890 to the flywheel 525 only while the shaft is accelerating the flywheel, and otherwise permits the flywheel to rotate independently. The flywheel clutch 1610 may be mechanical in nature, employing for example a pawl-and-ratchet or roller clutch assembly, or it may be an electromagnetic clutch, which is engaged and disengaged via computer control.

Rotational kinetic energy can be imparted to output shaft 890 from the explosive engine 590, or it may be derived from operation of the arm bar system, via an HBK power transfer linkage belt (not shown), which transfers force from the arm bar system HBK drive axle 560 (see FIG. 5) to shaft 890. Because the HBK drive axle 560 and shaft 890 are at right angles, preferred linkage belts are a round belt in a quarter-turn drive arrangement, or a synchronous belt or equivalent chain drive in combination with beveled gears on HBK drive axle 560. Thus, angular acceleration imparted to either the explosive engine or the arm bar system will cause the rotation of the flywheel 525 within the flywheel housing 520.

To permit the HBK system and explosive engine system to rotate independently of one another, a one-way clutch (not shown) is used to transfer power from the HBK linkage belt to the output shaft 890.

A one-way generator clutch 1620 is shown coaxial with, and located between, the flywheel 525 and the generator rotor 511. This is preferably an electromagnetic clutch, engaged as commanded by the computer control system, which transfers kinetic energy from the flywheel 525 to the generator rotor 511 as needed to meet the electrical load on the generator. The generator clutch can be disengaged in the absence of a load, to permit the flywheel to rotate freely without needlessly dissipating its kinetic energy. Rotor 511 rotates within stator 512 to produce electricity. In the embodiment shown, rotor 511 carries permanent magnets, and stator 512 comprises wire coils in which an alternating electric current is induced by the rotation of the rotor.

Power transfer interface 570 connects the generator 510 to the control panel 500. Interface 570 may simply conduct the generator output to the control panel, or it may comprise power conditioning circuitry to rectify and otherwise modulate the generator's output. The interface 570 preferably comprises plug connectors, so that the interface 570 and generator system 510 are readily removable and replaceable as complete modules.

Figure 18:
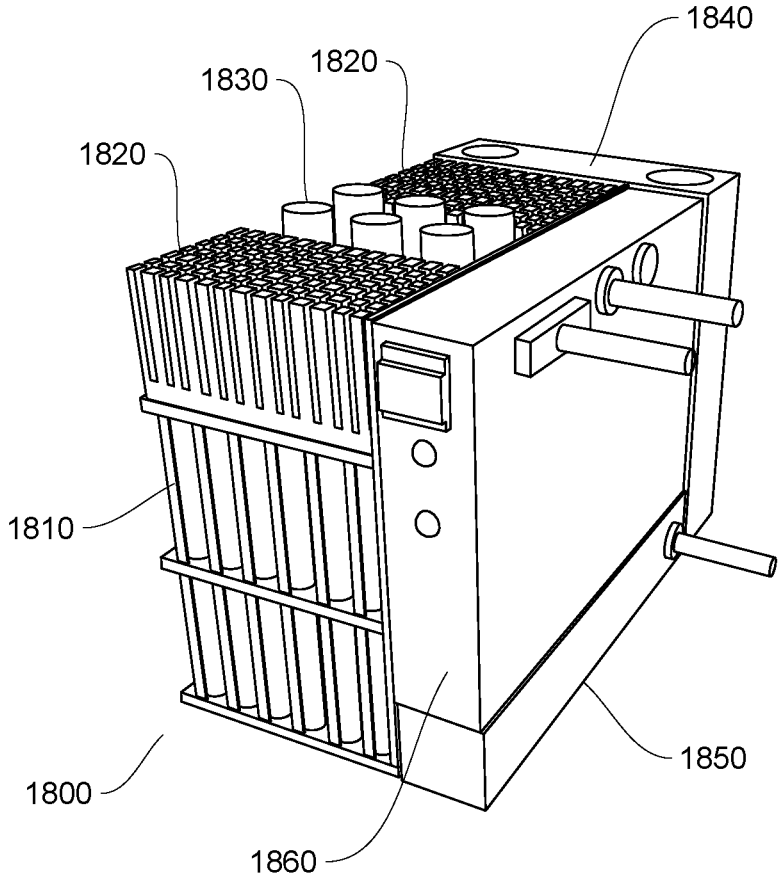
FIG. 18 is a perspective view of the battery storage and power control system.

FIG. 18 shows the electronics package 1800 of the POD generator. The electronics package comprises all electrical storage components, and all of the associated electronic components, that are packaged together and which regulate, modify, protect, cool, and recharge the power storage components of the POD generator. The interconnected components are: a battery stack 1810; one or more heat sinks 1820; one or more high-capacity capacitors (hi-caps) 1830; a cooling fan system 1840; a battery recharge system 1850; and a computer control system 1860. These grouped and interconnected electronic components function to accept, store, and dispense the electrical energy generated though operation of the POD generator.

Figure 19:
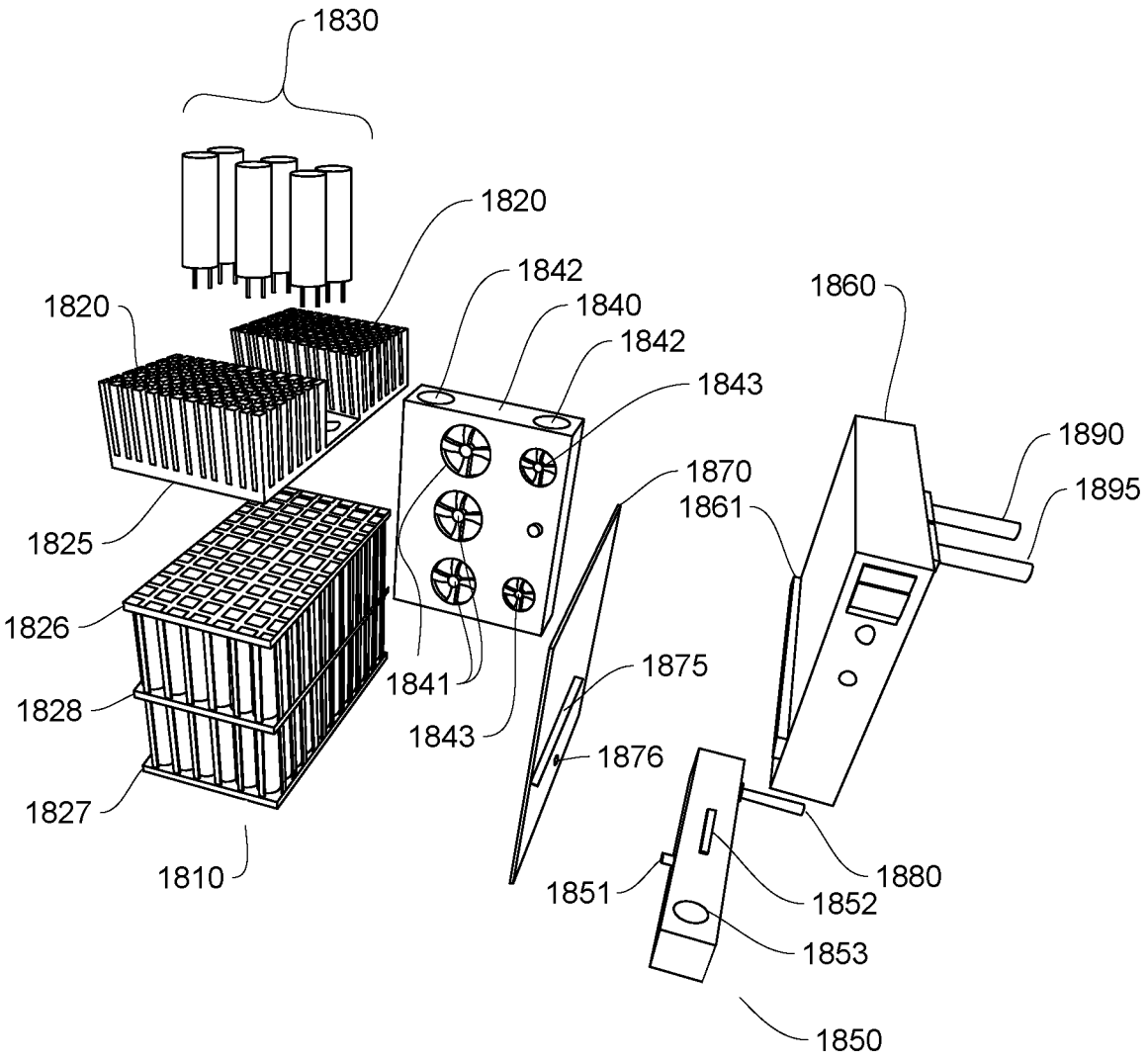
FIG. 19 is an exploded view of the battery storage and power control system.

FIG. 19 is an exploded view of the electronics package of FIG. 17. The package components, which are designed as plug-in replaceable modules, are as follows:

The main power storage system is the battery stack 1810. The side of the battery stack facing the computer control system 1860 has a connector strip that lines up with the pass through slot 1875 of the insulator pad 1870 so, when connected together, the computer control system 1860 can interface with the battery stack 1810 for the transfer of information and the routing, recharging and general management of the battery stack's electrical energy.

The heat sink 1820 is in thermal contact with elements of the battery stack 1810 and the high-capacity capacitors 1830 in a manner that allows any excess heat generated by the battery stack and capacitors to be wicked off and dissipated into air circulated through the heat sink by the cooling fan system 1840.

The high-capacity capacitors (hi-caps) 1830 are mounted to the upper surface of the top matrix printed circuit board 1826 via the pass-through openings in the heat sink plate 1825. The high-capacity capacitors 1830 are discharged and recharged as commanded by the computer control system 1860.

The cooling fan system 1840 has multiple fans 1841 and 1843, and pulls in exterior air via top vents 1842 and rear vents (not shown). Fans 1841 send cooling air into the battery stack 1810, and fans 1843 send air into recharge system 1850 and the computer control system 1860. The heated air is then vented through exhaust port 70 (FIG. 1).

The insulator pad 1870 separates and electronically and thermally insulates the computer control system 1860 from the battery stack 1810. The computer control system 1860 connects to center circuit board 1828 of the battery stack 1810 via connector 1861, passing through the pass-through slot 1875 of the insulator pad, while the battery recharge system 1850 is connected to the lower circuit board 1827 via connector 1851, passing through port 1876 in the insulator pad 1870.

The battery recharge system 1850 is connected to the computer control system 1860 via its top electronics connector 1852, which mates with a recharge connector (not shown) on the bottom of the computer control system 1860. The battery recharge system 1850 is thermally vented through computer control system 1860 via ventilation port 1853.

Power from the generator enters via cable 1880, and is distributed to the batteries in the stack by recharge system 1850 under control of computer control system 1860. Power is delivered from the battery stack to external loads, again under control of control system 1860, via low-current DC cable 1890 and high-current AC cable 1895. The low-current output is typically delivered at 12V DC, for use by electronic devices utilizing the automotive "lighter" plug, or for charging, e.g., lead-acid 12V batteries, and is stepped down to 5V for delivery to USB charging ports. High-current output is inverted to alternating current, and delivered at 120V AC to standard residential wall outlets. In some countries, models delivering 240V AC will be employed.

The computer control system 1860 is the operational heart of the POD generator 10. It controls the charging and discharging of the batteries, the operation of the explosive engine, the clutches controlling the flywheel and generator speeds, and the operation of the cooling fan system 1840, in response to the electrical loads placed on the system.

Figure 20:
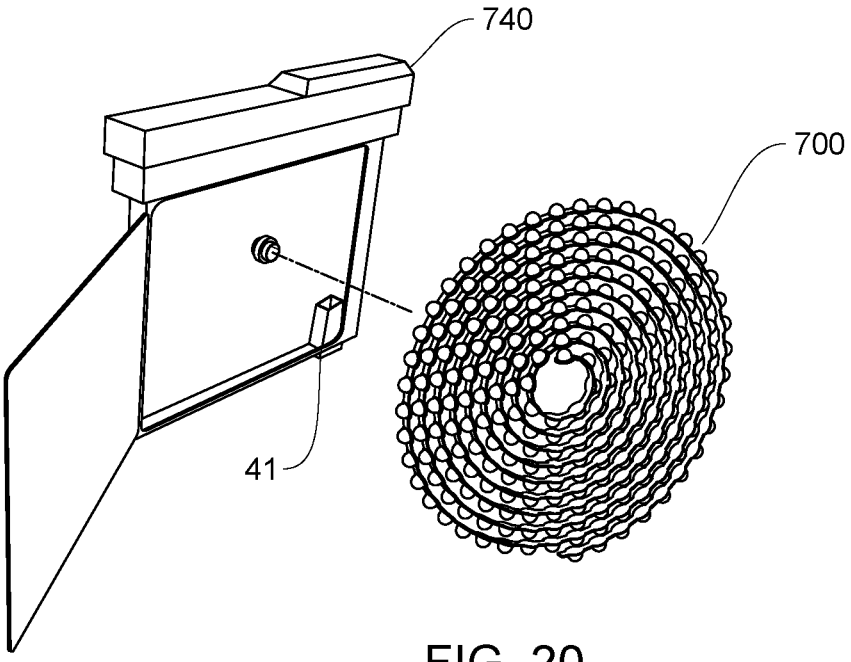
FIG. 20 shows a magazine and its contained strip of explosive charges.

FIG. 20 shows the interior of an opened magazine 740. The flexible belt 700 of explosive charges is coiled into a spiral and placed in the magazine around a central hub. The flexible belt facilitates the mechanized movement of charges from the magazine to the explosive engine. The magazine has a port 41 through which the belt and blanks are dispensed. With the coiled belt in place, the magazine is closed and then inserted into magazine holder 40 (FIG. 16.)

Figure 21:
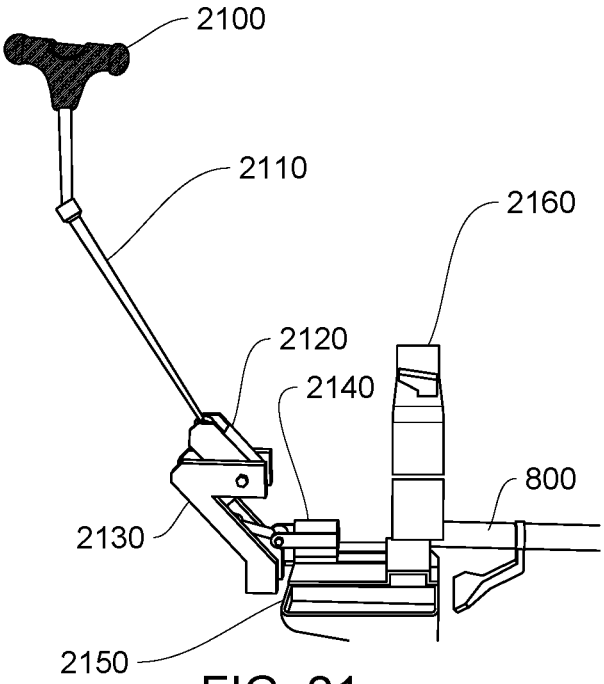
FIG. 21 shows the firing system with the breech in the open, loading configuration.

FIG. 21 shows the charge advancement and loading mechanism of the explosive engine in its "cocking" configuration. The charging handle 2100 is shown in its up and loading position, in which the charging handle shaft 2110 has been pulled up, raising the pull up pivot 2120 which rotates within support frame 2130. This draws the firing slide 2140 to its rearward (open) position, leaving open the breech in power flow entry tube 800. This permits ejection of any empty cartridge within the firing chamber into tray 2150. It also triggers a stepper motor (not shown) that drives indexing gears 2310 and 2320 (not shown, see FIG. 23) within gear housing 2160 to advance the belt 700 and place the next charge in position to be captured by the closing of the breech.

Figure 22:
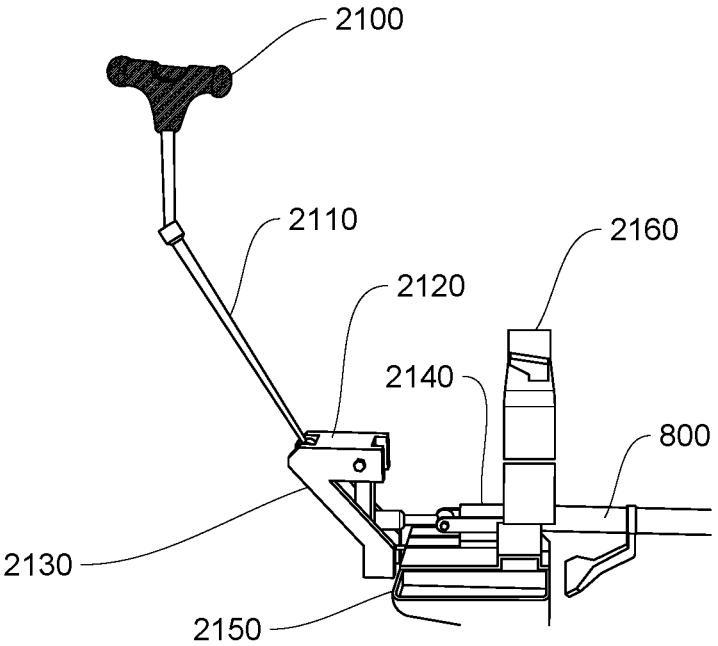
FIG. 22 shows the firing system with the breech in the closed and ready-to-fire configuration.

FIG. 22 shows the charge advancement and loading mechanism in its "loaded" configuration, with the firing chamber mechanism in the closed breech configuration. The charging handle 2100 is shown in its down and ready-to-fire position, in which the charging handle shaft 2110 and pivot 2120 have been pushed down, causing forward motion of the firing slide 2140. In this configuration, an explosive charge has been sealed within the closed breech, and the charge is ready to be ignited.

Figure 23:
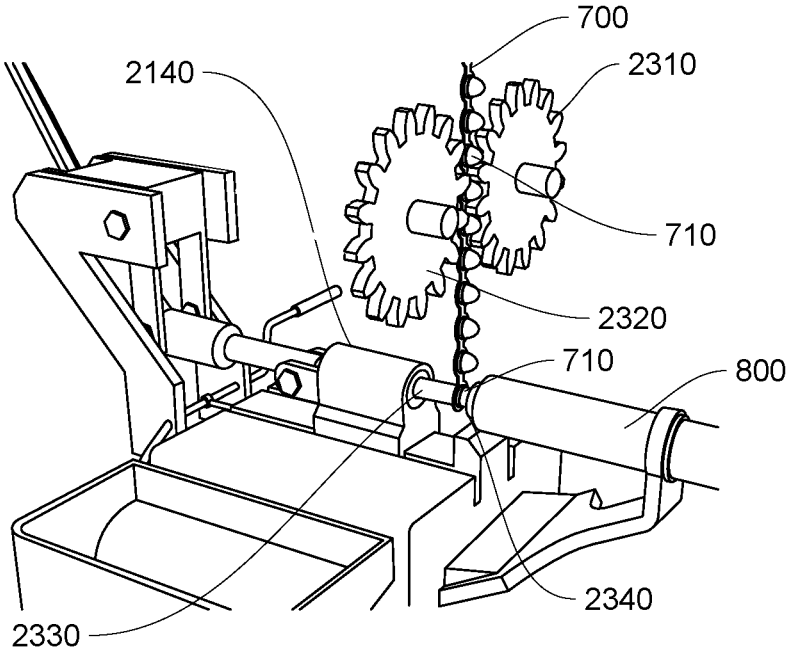
FIG. 23 shows the indexing mechanism for advancing the explosive charges into the breech.

FIG. 23 shows the indexing gears 2310 and 2320 engaged with the belt 700 of individual charges 710. (Gear housing 2160 has been omitted to enable this view.) Belt 700 has been advanced by the indexing gears to place a charge 710 between, and co-axial with, the open breech and the advancing firing slide 2140. Piston 2330 is equipped with a circular knife edge which presses against a complimentary anvil 2340 surrounding the open breech. The advancing piston severs a portion of the strip bearing a single explosive charge, and seals the charge into the firing chamber within tube 800, which produces the loaded configuration shown in FIG. 22.

The piston 2330 is further equipped with a means for igniting the charge once it is sealed within the closed breech. Depending upon the type of charge for which the piston is adapted, the means for ignition may be a conventional firing pin, activated by a solenoid (under computer control) or by a final downward push on the charging handle. Alternatively, the means for ignition may be electrodes inserted through the belt and into the explosive charge, for ignition by spark discharge, or by contact of the electrodes with conductive pads on the belt, for thermal ignition via a hot filament. The POD generator may be provided with a number of interchangeable pistons 2330, so that it can readily be adapted to explosive charges of varying design.

The indexing gears 2310 and 2320, and the gear housing 2160, are preferably modular in nature, so that the entire assembly can be replaced by indexing means adapted for different types of magazines. As noted above, there are numerous well-established and highly reliable magazines, with associated feed mechanisms, that are known in the firearms art, and most or all of these designs can be adapted for use in the explosive engine of the invention.

The explosive engine 540 can be energized on demand by the user, on a pre-set timed basis, or on a command for on-demand power issued by the computer control system 1860. The advancement, capture, and ignition of an explosive charge 710 can be achieved via commands from the computer control system delivered to a slide drive motor, index gear stepping motor, and firing solenoid or firing electrodes (not shown).

Subsequent to each firing of an explosive charge, the following sequence of events typically happens in a fraction of a second: The gear train 880 amplifies a single rotation of the gear ring 870 severalfold, so that rotation at the output shaft 890 can transfer sufficient speed to the flywheel 525 through the engaged flywheel clutch 1610. Electric energy is generated by generator 510, as angular momentum is transferred on demand from flywheel 525 via computer-controlled generator clutch 1620.

When the flywheel rotation speed, monitored via a tachometer, slows past an acceptable level as determined by the power management control algorithms, the POD generator can do one of two things: (1) the next energetic blank 710 can be advanced, loaded into the breech, and ignited, thus restoring the kinetic energy of the flywheel to a level adequate for further generation of electrical energy; or (2) the generator clutch can be disengaged, and generator 510 allowed to slow and stop, because the computer control system has determined that the output of the generator is no longer needed to support a load or recharge the battery system. The flywheel may be allowed to continue spinning, preserving its energy for a time, or it may be braked by topping off the battery, which applies a decelerating load on the generator.

The annular gear 870, the pinion gear 881, and preferably all other gears in the gear train 880 are "herringbone" style gears that minimize the likelihood of gear tooth breakage or deformation under the force of instant acceleration of the piston 860. In certain embodiments, additional pinion and intermediate gears may be present, creating a planetary gear system in which the impact forces are spread out over two or more gear trains.

For clarity of illustration, the piston and piston track are shown in the drawings with a rectangular cross-section. In such an embodiment, the piston would be closely fit to the upper, lower, and outer wall surfaces. Other piston cross-sections may be employed, such as a D-shape, or a piston with a substantially circular cross-section may be fused at one edge to the annular gear, with the piston track appropriately shaped to fit. Sliding dry seals, for example as described in U.S. Pat. No. 4,411,436, may be employed to minimize leakage of high-pressure gas from behind the piston.

The use of one-way clutch 1610 between the explosive engine 590 and the flywheel 525, and one-way clutch 1620 between the flywheel and the generator 510, allows the controlled flow of kinetic energy from the flywheel to the generator, so as to optimize the spin of the generator 510 so that it produces a steady voltage. With a polyphase AC generator, it will be desirable to maintain the output frequency within a range that is compatible with the inverter circuits. The one-way flywheel clutch 1610 allows the explosive engine 520 to slow or stop its input of kinetic energy while the flywheel 525 maintains its angular momentum. The generator clutch 1620 allows the flywheel 525 to vary in speed, while generator 510 continues to spin at its most efficient rate.

The explosive engine has the ability to create substantial rotational kinetic energy, in the form of an initial burst of thousands of rotations per minute (rpm) but rapidly dropping to zero after a single rotation of the engine. The initial burst of energy is transferred through the primary clutch to the flywheel 525, which is spun up in increments so as to store the accumulated output of the explosive engine 590. The kinetic energy of the flywheel is transferred on demand, via the generator clutch 1620, into the generator system 510. The flywheel 525 slows its rotation if no further kinetic energy is delivered from the explosive engine, but the generator system 510 can keep spinning at whatever speed it has attained, and independently slow according to the electrical load placed upon it, due to the disengagement of the clutch 1620. Rotational speeds of each component (explosive engine 590, flywheel 525 and generator 510) are tracked via tachometers connected to the computer control system 1860. The POD generator uses the speed sensors to sense when continuous power is needed or bursts of power are required to recharge any parts of the battery stack 1810. The power management algorithms can activate the loading and ignition of blanks 710 as needed to spin up the flywheel 525, and thereby keep the generator 510 at optimum speed, and can also manage the engagement and disengagement of the electromagnetic clutches.

The electrical energy that flows from the generator 510 is guided, via a power cable 1880, to the electronics 1850 regulating battery stack 1810. The battery stack contains multiple stacks of rechargeable cells. Suitable rechargeable cells for use in the POD generator include but are not limited to lead-acid, NiCd, NiMH, Li-ion, LiFePO4, and Li-ion polymer batteries. The system may be designed to accommodate any size of cell deemed to be desirable, including but not limited to traditional "D" cells, "C" cells, "AA" cells, and "AAA" cells, and the standard lithium cell sizes 18650, 21700, 26650 and 4680. It is possible to charge, or maintain a desired charge level, of the battery stack using ordinary household current. This is a convenient way to maintain the battery stack in a stable, long-term storage state (typically, lithium cells are best stored at about 50% capacity), and to bring it into a ready-to-use, fully-charged state when the use of the POD generator is anticipated.

The full electronics package 1800 incorporates the capabilities of an intelligent battery system capable of regulating the POD generator's internal power management, power distribution and the discharging and recharging of its modular battery stack 1810 on demand. Part of the intelligent battery system's functionality is to monitor the rotation of the explosive engine 590, the flywheel 525 and the generator 510 via speed sensors connected to the POD generator's integral computer control system 1860. If the POD generator's battery stack 1810 is fully charged, and there is no immediate need for more electrical energy from the generator 510, then the flywheel 525 will be allowed to spin freely, preserving some fraction of its kinetic energy for a time before eventually slowing and stopping.

Control algorithms and systems management algorithms operating within the computer control system 1860 base their operational decisions on multiple parameters, including the tachometer inputs, the power output of the generator, and the readings from power usage sensors. If there is no active load detected, and no demand from the battery charging circuitry, there will be no automatic activation of the explosive engine until new electrical demand is detected by the computer control system 1860, or the charge level of the battery stack 1810 has dropped below a predetermined level. At that point the computer control system 1860 will activate the explosive engine 590, delivering kinetic rotational energy to the flywheel 525 and generator 510. The net result is a maximally efficient, entirely "on-demand" usage of the POD generator's energy source, the energetic charges 710.

If the computer control system senses that a large load has been placed upon the POD generator, and it is calculated by that the stored power within the battery stack 1810 will be drained over a short time by the attached load, the computer control system 1860 will initiate a sequential release of energetic charges, and direct the electrical energy produced by the generator 510 directly to the attached electrical load. This allows the system to retain stored power in the battery stack 1810, for use by any smaller loads that may be connected. Depending upon the electrical loads placed on the POD generator, the frequency of the discharge of the energetic cartridge system will be scaled appropriately to maintain the rotation of the flywheel and generator as necessary to meet the demands of the load. Once the larger load is disconnected, the battery stack will have its reserves replenished under the management of the computer control system 1860, via further releases of energy from the explosive engine.

The higher the direct load placed upon the generator 510, the higher the resistance to rotation of the rotor. The amount of energy drawn from the flywheel will increase, and the computer control system 1860 detect a slowing in its rotation rate and compensate by activating the explosive engine, as often as needed to maintain an optimum rotation rate. The frequency of discharge of energetic cartridges in the explosive engine will thus increase in proportion to the load.

The user interface on the control panel 500 preferably has a flip-up data display touch screen that can be tilted forward or backwards, to allow easy reading whether the user is operating the arm bars or accessing the magazine, firing handle, or other features from the opposite side of the POD generator. The computer control system capabilities are preferably accessed via a graphical user interface, using icons and menus selectable with the touch screen. Numerical parameters can be entered via a physical or on-screen numeric keypad.

The explosive engine and POD generator of the invention have other uses. For example, it is expected that the fraction of individual consumers driving electric vehicles (EVs) will rise steadily from its current level, and a growing number of people, especially in urban areas, are already using electric bikes for transportation. The number of people dependent upon the power grid for their transportation needs will increase accordingly. Emergency services, disaster relief agencies, and the military will likely retain gasoline- and diesel-fueled vehicles, but a large civilian population would be stranded in the event of a prolonged power outage, if a source of emergency power generation was not available to them.

This creates a need that can be met by another aspect of the POD generator. The explosive engine and generator assembly of FIG. 16 can be built into an EV, where it serves as a backup energy supply capable of adding energy to the vehicle's battery. Alternatively, assembly 16 can be built into a module that is reversibly mountable in an EV, so that it can be stored until needed. The POD generator described above can, of course, be used as a stationary recharging station. The explosive engine of the invention is expected to add enough driving distance to a typical EV (10-20 miles) to take drivers and their passengers out of danger in the more common disaster scenarios, such as storms, wildfires and earthquakes.

Gas stations depend on electric pumps to dispense gasoline and diesel from underground tanks, and in a prolonged power outage the operation of these pumps becomes critical. The POD generator of the invention can supply sufficient power to operate such pumps.

In addition to its utility as the driver of electrical generators, the explosive engine of the invention can be used as a source of mechanical energy, especially when equipped with an operatively connected flywheel. Water pumps and water filtration devices, for example, are often needed under emergency conditions, and can be mechanically linked to the flywheel of the explosive engine of the invention.

I claim:

1. An engine for obtaining kinetic rotational energy from the explosive decomposition of an energetic material, comprising:

a) an annular piston track comprising a stationary wall section and a rotating wall section, the rotating wall section being free to rotate around the axis of the annulus;

b) fixed to the rotating wall section, a piston fitting closely within the annular piston track and traveling within the annular piston track as the rotating wall section rotates;

c) on the side of the rotating wall section exterior to the annular piston track and facing the axis of the annulus, regularly spaced gear teeth arranged so that the rotating wall section is capable of serving as an annular gear;

d) a gear train, comprising a pinion gear operatively engaged with the annular gear, and an output shaft driven by the gear train;

e) a one-way clutch operatively engaged with the output shaft;

f) a flywheel operatively engaged with the one-way clutch, the one-way clutch being oriented to transmit torque from the output shaft to the flywheel;

g) a power flow entry tube adapted at its near end to receive expanding gases produced by the explosive decomposition of the energetic material, and terminating at its distal end in an attached partition, the partition having a port that passes through the partition and delivers the expanding gases into the annular piston track behind the piston, so as to propel the piston forward and around the annular piston track;

h) a pivot integrated into the power flow entry tube, which enables the distal end of the power flow entry tube and the attached partition to be rotated between a first state in which the partition seals the annular piston track, and a second state in which the partition is entirely clear of the annular piston track; and i) a movable stop pawl, operatively linked to the partition and movable into and out of the annular piston track;

wherein distal end of the power flow entry tube and the attached partition are configured to rotate from the first state to the second state when displaced by the piston, so as to permit passage of the piston, and configured to rotate back into the first state after passage of the piston;

wherein the rotation of the partition into the second state causes the stop pawl to move into the annular piston track and halt the movement of the piston; and wherein the stop pawl is configured to move out of the annular piston track when the flow entry tube and the partition rotate back into the first state after passage of the piston.

2. The engine according to claim 1, further comprising j) a user-operated mechanism operatively linked to a magazine holder, for drawing an individual charge of the energetic material from a magazine and transferring the charge into the near end of the power flow entry tube; and k) a user-operated mechanism for igniting the individual charge within the power flow entry tube.

3. The engine according to claim 2, further comprising a magazine holder configured to hold a magazine of individual charges of the energetic material.

4. The engine according to claim 3, wherein the individual charges of the energetic material are uniformly spaced along a flexible belt.

5. The engine according to claim 1, further comprising a magazine holder configured to hold a magazine of individual charges of the energetic material.

6. The engine according to claim 5, wherein the individual charges of the energetic material are uniformly spaced along a flexible belt.

7. A portable on-demand electrical generation system, comprising the engine according to claim 1, operatively linked via a second one-way clutch to a generator, the second one-way clutch being oriented to transmit torque from the flywheel to the generator.

8. The portable on-demand electrical generation system of claim 7, wherein the engine further comprises j) a user-operated mechanism operatively linked to the magazine holder, for transferring an individual charge of the energetic material into the near end of the power flow entry tube; and k) a user-operated mechanism for igniting the individual charge within the power flow entry tube.

9. The portable on-demand electrical generation system of claim 8, wherein the engine further comprises a magazine holder configured to hold a magazine of individual charges of the energetic material.

10. The portable on-demand electrical generation system according to claim 9, further comprising a battery for storing electrical energy.

11. The portable on-demand electrical generation system according to claim 8, further comprising a battery for storing electrical energy.

12. The portable on-demand electrical generation system of claim 7, wherein the engine further comprises j) a computer-operated mechanism operatively linked to the magazine holder, for transferring an individual charge of the energetic material into the near end of the power flow entry tube; and k) a computer-operated mechanism for igniting the individual charge within the power flow entry tube.

13. The portable on-demand electrical generation system of claim 12, wherein the engine further comprises a magazine holder configured to hold a magazine of individual charges of the energetic material.

14. The portable on-demand electrical generation system according to claim 13, further comprising a battery for storing electrical energy.

15. The portable on-demand electrical generation system according to claim 14, further comprising a computer configured to monitor a) the charge state of the battery, b) an electrical load placed on the generation system, and c) the rotation speeds of the flywheel and generator, and configured to operate the mechanism for transferring an individual charge of the energetic material into the near end of the power flow entry tube, and the mechanism for igniting the individual charge within the power flow entry tube, in response to a need for electrical power presented by the load.

16. The portable on-demand electrical generation system according to claim 12, further comprising a battery for storing electrical energy.

17. The portable on-demand electrical generation system of claim 7, wherein the engine further comprises a magazine holder configured to hold a magazine of individual charges of the energetic material.

18. The portable on-demand electrical generation system according to claim 17, further comprising a battery for storing electrical energy.

19. The portable on-demand electrical generation system according to claim 7, further comprising a battery for storing electrical energy.

* * * * *